US012653264B2

(12) United States Patent
Robinson

(10) Patent No.: US 12,653,264 B2
(45) Date of Patent: Jun. 16, 2026

(54) BRACED FOOTWEAR SYSTEMS

(71) Applicant: Pauline Patricia Robinson, Port Saint Lucie, FL (US)

(72) Inventor: Pauline Patricia Robinson, Port Saint Lucie, FL (US)

( * ) Notice: Subject to any disclaimer, the term of this patent is extended or adjusted under 35 U.S.C. 154(b) by 0 days.

(21) Appl. No.: 19/176,901

(22) Filed: Apr. 11, 2025

(65) Prior Publication Data

US 2026/0007201 A1 Jan. 8, 2026

Related U.S. Application Data

(60) Provisional application No. 63/667,043, filed on Jul. 2, 2024.

(51) Int. Cl.

| | |
|---|---|
| ***A43B 13/12*** | (2006.01) |
| ***A43B 3/00*** | (2022.01) |
| ***A43B 7/14*** | (2022.01) |
| ***A43B 7/22*** | (2006.01) |

(52) U.S. Cl.

CPC ..... *A43B 3/0036* (2013.01); *A43B 7/14* (2013.01); *A43B 7/22* (2013.01); *A43B 13/12* (2013.01)

(58) Field of Classification Search

CPC ..... A43B 7/20; A43B 7/22; A43B 13/026; A43B 13/12; A43B 13/127

USPC ..... 36/88, 89, 110

See application file for complete search history.

(56) References Cited

U.S. PATENT DOCUMENTS

| | | | | |
|---|---|---|---|---|
| 3,765,409 | A * | 10/1973 | Merkle | A43B 3/02 36/89 |
| 5,430,960 | A | 7/1995 | Richardson | |
| 5,675,915 | A * | 10/1997 | Faughn | A43B 5/18 36/114 |
| 5,678,330 | A | 10/1997 | Van Dyke et al. | |
| 5,720,118 | A * | 2/1998 | Mayer | A43B 7/1425 36/107 |
| 7,069,670 | B1 * | 7/2006 | Gerke | A41D 17/00 2/22 |
| 7,370,442 | B2 | 5/2008 | Jung et al. | |
| 7,475,501 | B1 | 1/2009 | DeToro et al. | |
| 11,730,235 | B2 | 8/2023 | Brown | |
| 2005/0126044 | A1 * | 6/2005 | Langley | A43B 19/00 36/89 |
| 2006/0096126 | A1 * | 5/2006 | Krauss | A43B 3/18 36/50.1 |
| 2007/0113427 | A1 | 5/2007 | Mansfield | |
| 2009/0064538 | A1 * | 3/2009 | Roether | A43B 13/026 36/25 R |
| 2009/0083996 | A1 * | 4/2009 | Clancy | A43C 15/00 36/8.1 |
| 2012/0255194 | A1 * | 10/2012 | Schwartz | A61F 5/0127 36/19.5 |
| 2014/0215854 | A1 * | 8/2014 | Girard | A43C 15/068 36/114 |

(Continued)

*Primary Examiner* — Marie D Bays

(74) *Attorney, Agent, or Firm* — John Rizvi; John Rizvi, P.A.—The Patent Professor®

(57) ABSTRACT

Lightweight braced footwear systems configured to conceal deformity, injury or paralysis in the foot of a wearer may include footwear having a footwear body. A footwear sole may be provided on the footwear body. At least one footwear brace may be provided in the footwear sole. The footwear brace may be discreetly concealed in the footwear sole. The footwear brace may impart support to a deformed, injured or paralyzed foot.

13 Claims, 5 Drawing Sheets

(56) References Cited

U.S. PATENT DOCUMENTS

| | | | | |
|---|---|---|---|---|
| 2015/0033585 | A1* | 2/2015 | Otus | A43B 3/0031 36/109 |
| 2015/0150703 | A1 | 6/2015 | Chang | |
| 2019/0365033 | A1* | 12/2019 | Chambers | A43B 13/125 |
| 2021/0085025 | A1* | 3/2021 | Geis | A43B 5/06 |
| 2022/0287405 | A1* | 9/2022 | Cheney | A43B 3/0057 |
| 2023/0124653 | A1* | 4/2023 | Farina | A43B 13/41 36/25 R |
| 2023/0255308 | A1* | 8/2023 | Bidal | A43B 13/12 36/127 |
| 2024/0081476 | A1* | 3/2024 | Zheng | A43B 13/188 |

* cited by examiner

BRACED FOOTWEAR SYSTEMS

CROSS-REFERENCE TO RELATED APPLICATIONS

This application claims the benefit of U.S. Provisional Patent Application Ser. No. 63/667,043, filed on Jul. 2, 2024, which is incorporated by reference herein in its entirety.

FIELD OF THE INVENTION

The present invention relates generally to footwear, and more particularly, to lightweight braced footwear systems which are built into the sole of footwear to conceal deformity, injury or paralysis in the foot of a wearer.

BACKGROUND OF THE INVENTION

Various types of braces designed to control, constrain or support the position of the foot and/or ankle are known. Some of these braces are designed to compensate for weakness or correct deformities in the foot or ankle. Braces can be used to support a weak foot or ankle or to position a weak, paralyzed or deformed foot or ankle into a more normal position. Some types of braces may be used to control foot drop caused by any of a variety of neurologic and musculoskeletal disorders.

Some types of braces, known as AFO (Ankle Foot Orthosis) braces, are commonly used in wearers who suffer from drop foot. Drop foot is a neural disorder in which the toes of the foot cannot be dorsiflexed, or raised up, from the ankle. Consequently, the foot is stuck in a plantar flexed, or hanging, position and drags on the ground during walking. Drop foot is commonly caused by stroke and may be a prominent feature of such disorders as ALS, muscular dystrophy, multiple sclerosis, cerebral palsy, bone sarcoma, and aplastic paraplegia.

A standard or conventional AFO brace may include an L-shaped frame which extends around the foot and ankle from just below the knee to the metatarsal heads of the foot. AFO braces can be purchased off the shelf or can be custom molded to an individual wearer. AFO braces can be fabricated of a variety of materials including heat-moldable plastics, metal, leather and carbon composite. AFO braces make up about twenty-six percent (26%) of all such orthoses provided in the United States.

One of the drawbacks of conventional AFO and other foot/ankle orthotic braces is that the braces may add substantial bulk to the foot of the wearer. Accordingly, shoes that are substantially larger than the size of the wearer's foot may be required to accommodate the brace. The larger shoe may also add an undesirable amount of weight to the wearer's foot, which may likewise cause the foot to become stuck in the plantar flexed (hanging) position.

Accordingly, there is need for lightweight braced footwear systems which are built into the sole of footwear to conceal deformity, injury or paralysis in the foot of a wearer.

SUMMARY OF THE INVENTION

The present invention is directed to lightweight braced footwear systems which are built into the sole of footwear to conceal deformity, injury or paralysis in the foot of a wearer. An illustrative embodiment of the braced footwear systems may include footwear having a footwear body. A footwear sole may be provided on the footwear body. At least one footwear brace may be provided in the footwear sole. The footwear brace may be discreetly concealed in the footwear sole. The footwear brace may impart support to a deformed, injured or paralyzed foot.

In an illustrative implementation of the invention, lightweight braced footwear systems which are built into the sole of footwear to conceal deformity, injury or paralysis in the foot of a wearer may include footwear having a footwear body. A footwear sole may be provided on the footwear body. At least one brace space may be provided in the footwear sole. At least one footwear brace may be provided in the brace space. The footwear brace may be discreetly concealed in the brace space in the footwear sole. The footwear brace may impart support to a deformed, injured or paralyzed foot of the wearer as the wearer wears the footwear.

In another illustrative implementation of the invention, lightweight braced footwear systems which are built into the sole of footwear to conceal deformity, injury or paralysis in the foot of a wearer may include footwear having a footwear body. A footwear sole may be provided on the footwear body. At least one brace space may be provided in the footwear sole. At least one footwear brace may be provided in the brace space. The footwear brace may be discreetly concealed in the brace space in the footwear sole. The footwear brace may include at least one vertical brace member. The vertical brace member of the footwear brace may impart vertical support to a deformed, injured or paralyzed foot of the wearer as the wearer wears the footwear.

In a second aspect, the footwear body may include a front body portion, side body portions, a rear body portion, a top body portion and a bottom body surface. The footwear sole may be provided on the bottom body surface of the footwear body.

In another aspect, the footwear may be a shoe.

In another aspect, the footwear may be a boot.

In another aspect, the boot may include a footwear ankle portion extending from the footwear body.

In another aspect, the footwear ankle portion may have an ankle portion interior and an upper ankle portion edge.

In another aspect, the footwear ankle portion may include a slit having side slit edges. The side slit edges of the slit may be separated to deploy the slit from a closed slit configuration to an open slit configuration which facilitates placement of the wearer's foot into and removal of the wearer's foot from the footwear.

In another aspect, a slit closure mechanism may facilitate selective deployment of the slit in the closed slit configuration and the open slit configuration.

In another aspect, the slit closure mechanism may include a zipper.

In another aspect, the slit closure mechanism may include snaps, buttons, hook and loop fasteners and/or laces.

In another aspect, a releasable closure strap may be selectively securable around the footwear ankle portion to secure the slit closure mechanism in the closed slit configuration.

In another aspect, the closure strap may have strap ends. A strap buckle may releasably secure the strap ends to each other.

In another aspect, the strap buckle may have a strap buckle release button. The strap buckle release button may be depressed to release the strap buckle.

In another aspect, the footwear sole may have a front sole portion, side sole portions and a rear sole portion. The front sole portion, the side sole portions and the rear sole portion of the footwear sole may correspond in position to the front body portion, the side body portions and the rear body portion, respectively, of the footwear body. The brace space may be coextensive in area with at least part of the front sole portion, the side sole portions and the rear sole portion.

In another aspect, the footwear sole may include an outer sole panel. The outer sole panel may form the front sole portion, the side sole portions and the rear sole portions of the footwear sole. The brace space may be formed by and between the outer sole panel of the footwear sole and the bottom body surface of the footwear body.

In another aspect, a brace panel may line an interior surface of the outer sole panel. The vertical brace members of the footwear brace may extend between the brace panel and the bottom body surface of the footwear body.

In another aspect, each vertical brace member of the footwear brace may include a pair of adjacent brace member elements.

In another aspect, the brace member elements may impart a spring action to each vertical brace member. The vertical brace members may impart vertical support to the foot (not illustrated) of the footwear wearer as the footwear wearer stands, walks or runs in the footwear.

In another aspect, the brace member elements of each vertical brace member may be bowed outwardly with respect to each other to impart the spring action to the vertical brace member.

In another aspect, each brace member element of each vertical brace member may be fabricated of a flexible or resilient material such as metal, plastic, rubber, composite materials, or combinations thereof.

In another aspect, each brace member element of each vertical brace member may be a solid flexible material.

In another aspect, each vertical brace member may include at least one coiled spring.

In another aspect, horizontal brace members may connect the adjacent vertical brace members to each other.

In another aspect, the horizontal brace members may connect the brace member elements of each vertical brace member to the brace member elements of the adjacent vertical brace members.

In another aspect, each horizontal brace member of the footwear brace may be fabricated of a flexible or resilient material such as metal, plastic, rubber, composite materials, or combinations thereof.

In another aspect, each horizontal brace member may be a solid flexible material.

In another aspect, each horizontal brace member may include at least one coiled spring.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments, unless the claims state otherwise. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise. As used throughout the specification and claims, the term "comprising" can also encompass the terms "consisting essentially of" and "consisting of". The term "about" has the meaning reasonably ascribed to it by a person skilled in the art when used in conjunction with a stated numerical value or range, i.e., denoting from the exact stated value or range to somewhat more or somewhat less than the stated value or range, from a deviation of from 0% with respect to the stated value or range to up to and including 10% of the stated value or range in either direction.

Shown throughout the figures, the present invention is directed toward lightweight braced footwear systems which are built into the sole of footwear to conceal deformity, injury or paralysis in the foot of a wearer.

Figure 2A:
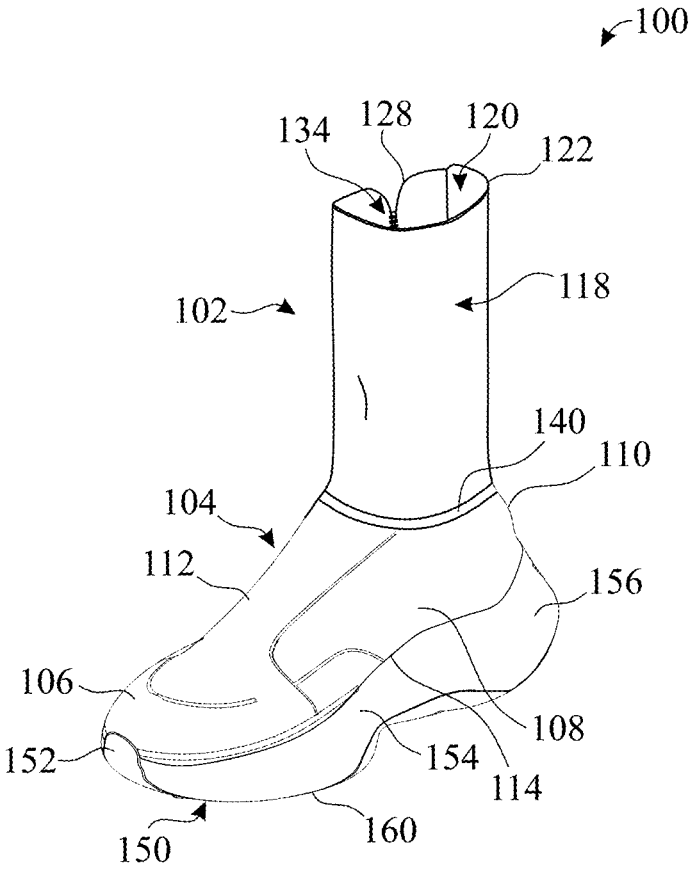
FIG. 2A presents a left front perspective view of the braced footwear system illustrated in FIG. 1.
Figure 2B:
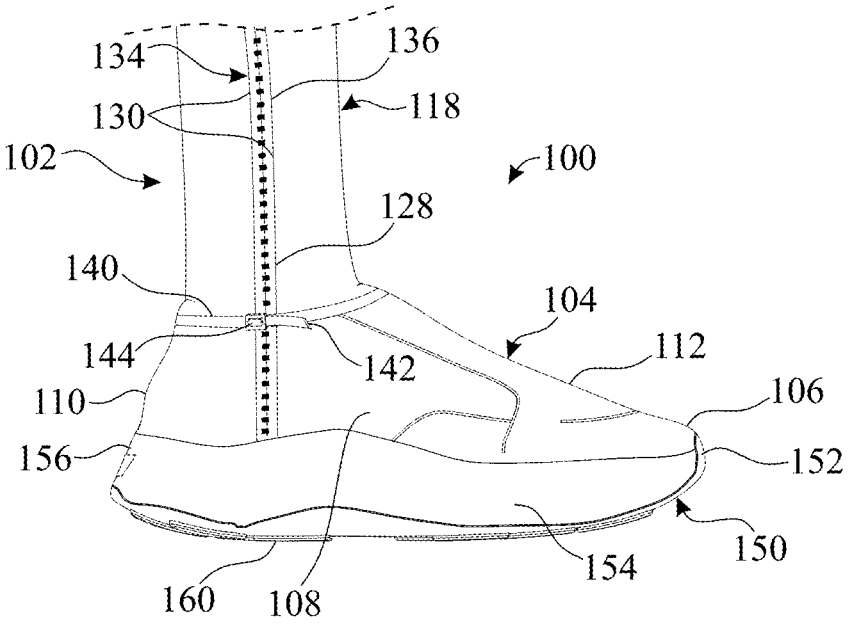
FIG. 2B presents a right view, partially in section, of the braced footwear system.
Figure 3:
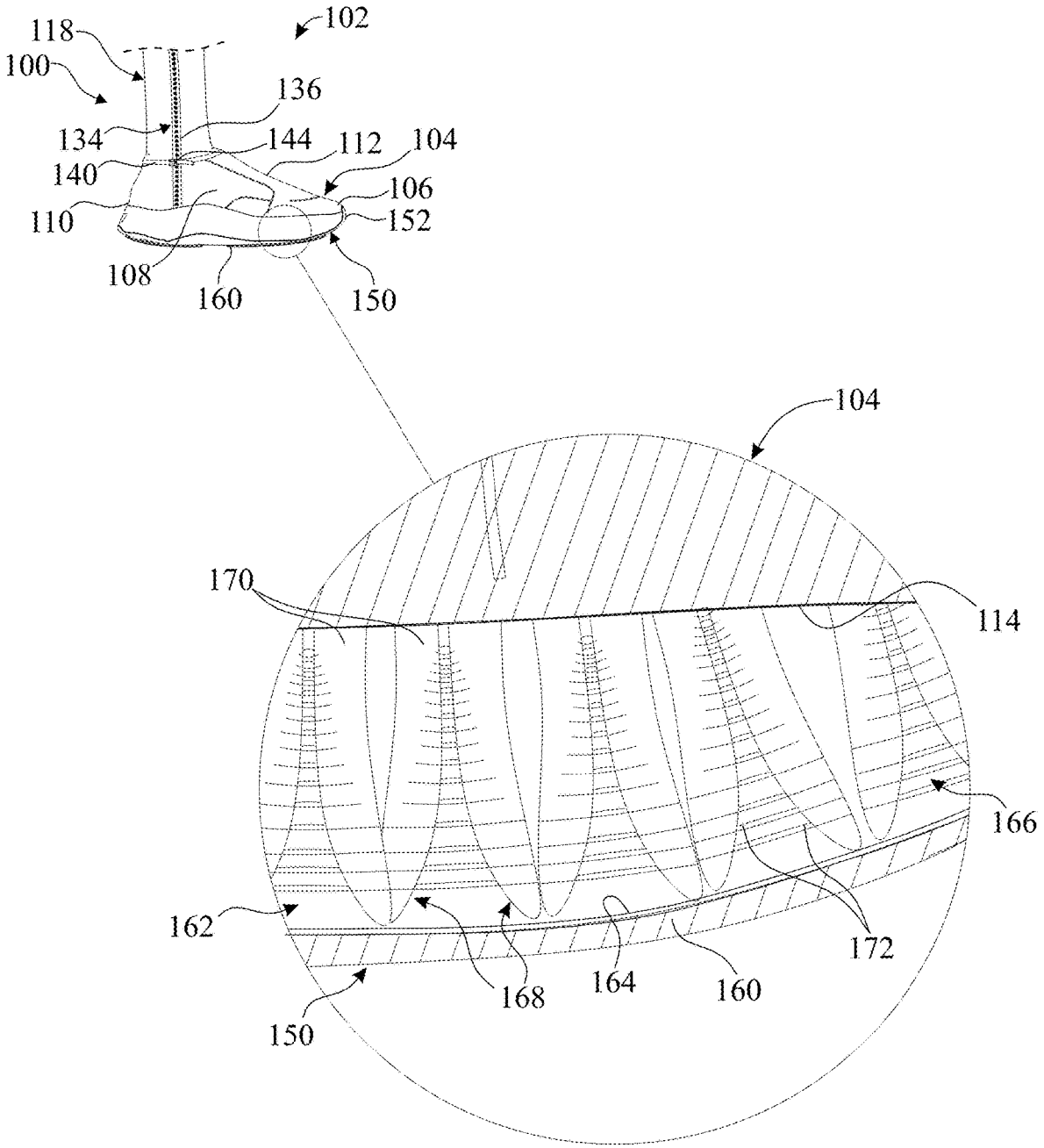
FIG. 3 presents an enlarged sectional view of a typical footwear brace in the brace space of the footwear sole.
Figure 4A:
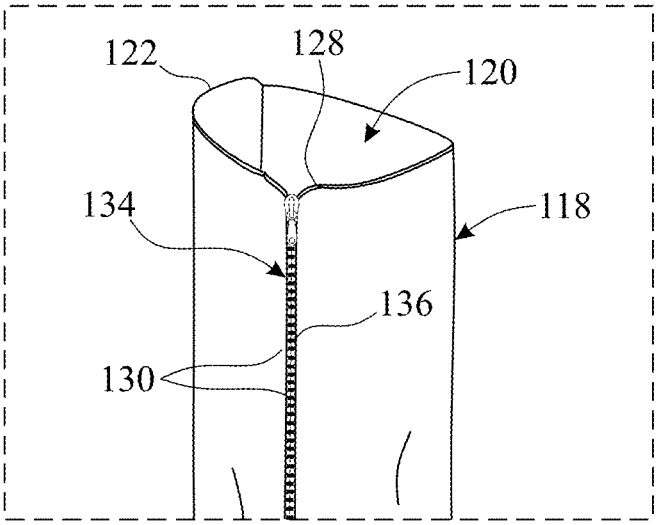
FIG. 4A presents a sectioned perspective view of the upper portion of the footwear ankle portion of the footwear with the slit closure mechanism deploying the slit in the closed slit configuration.
Figure 4B:
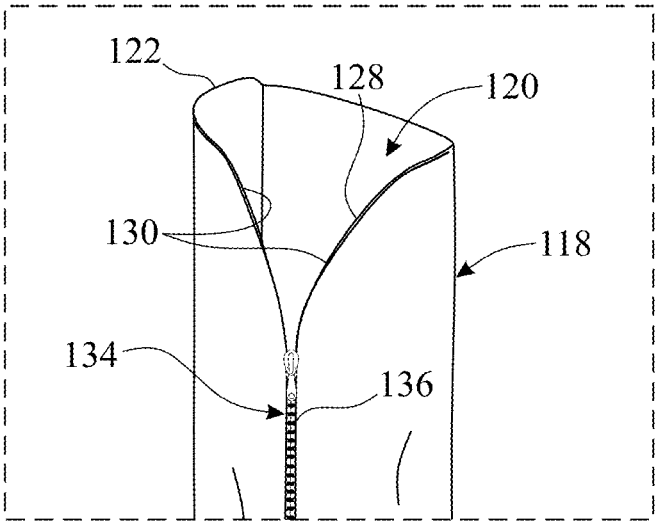
FIG. 4B presents a sectioned perspective view of the upper portion of the footwear ankle portion of the footwear with the slit closure mechanism deploying the slit in a partially open slit configuration.
Figure 5:
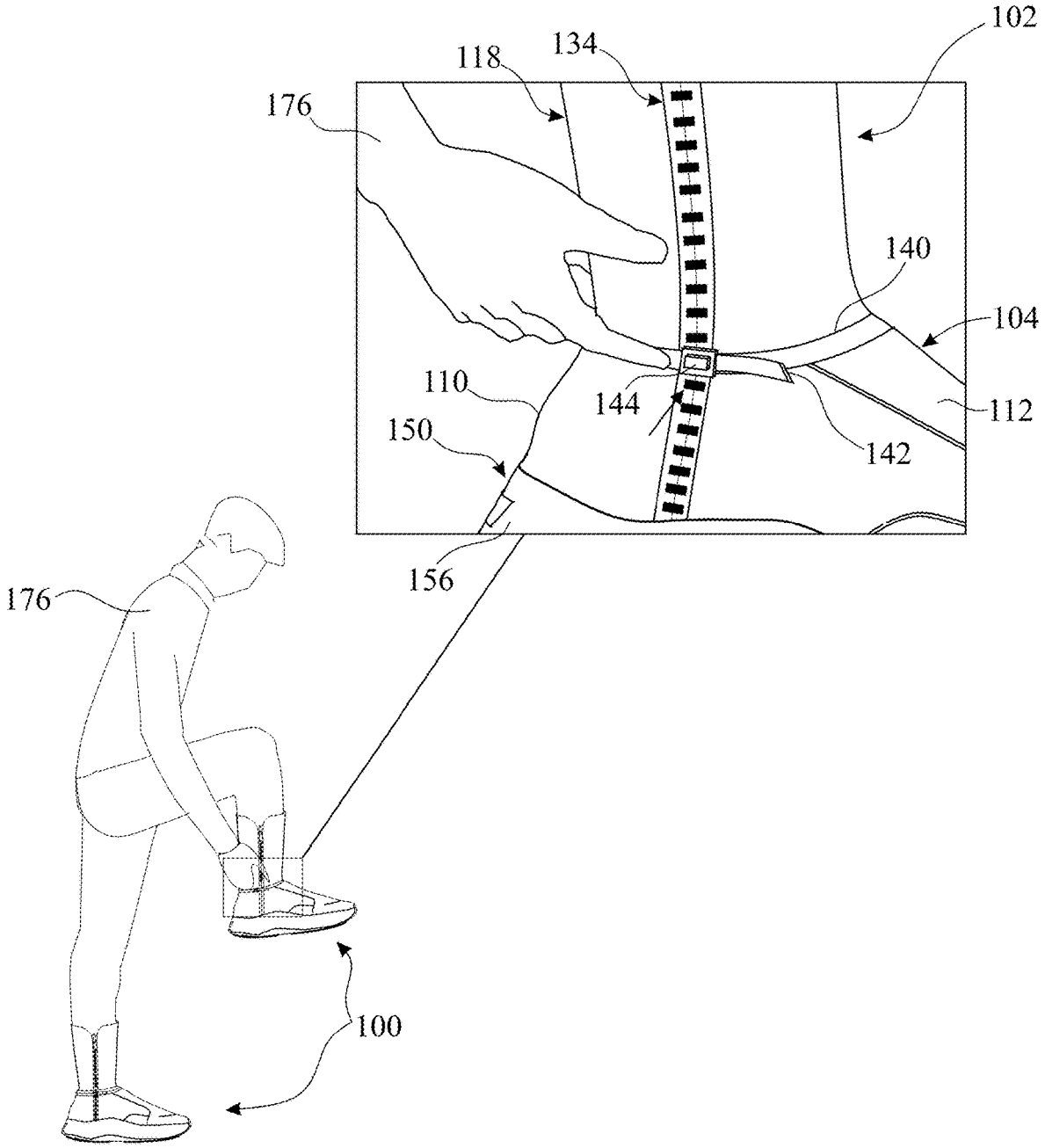
FIG. 5 presents an enlarged sectional view of a footwear wearer releasing the strap buckle release button on the strap buckle of the closure strap to facilitate operation of the slit closure mechanism.

Referring initially to FIGS. 1-5, a braced footwear system 100 is illustrated in accordance with an exemplary embodiment of the present invention. As shown for instance in FIG. 1, the braced footwear system 100 may include footwear 102 having a footwear body 104. A footwear sole 150 may be provided on the footwear body 104. As illustrated in FIG. 3, at least one footwear brace 166 may be provided in the footwear sole 150. The footwear brace 166 may be discreetly concealed in the footwear sole 150. The footwear brace 166 may impart support to a deformed, injured or paralyzed foot (not illustrated) of a footwear wearer 176 (FIG. 5).

As further illustrated in FIG. 3, in some embodiments, at least one brace space 162 may be provided in the footwear sole 150. At least one footwear brace 166 may be provided in the brace space 162. The footwear brace 166 may be discreetly concealed in the brace space 162 in the footwear sole 150.

In some embodiments, the footwear brace 166 may include at least one, and typically, multiple vertical brace members 168. The vertical brace members 168 may be disposed in adjacent relationship to each other along the length and/or width of the footwear sole 150. The vertical brace member 168 of the footwear brace 166 may impart vertical support to a deformed, injured or paralyzed foot of the footwear wearer 176 as the footwear wearer 176 wears the footwear 102.

The footwear body 104 of the footwear 102 may include a front body portion 106, side body portions 108, a rear body portion 110 and a top body portion 112. As illustrated in FIG. 3, the footwear body 104 may have a bottom body surface 114. The footwear sole 150 may be provided on the bottom body surface 114 of the footwear body 104.

Figure 1:
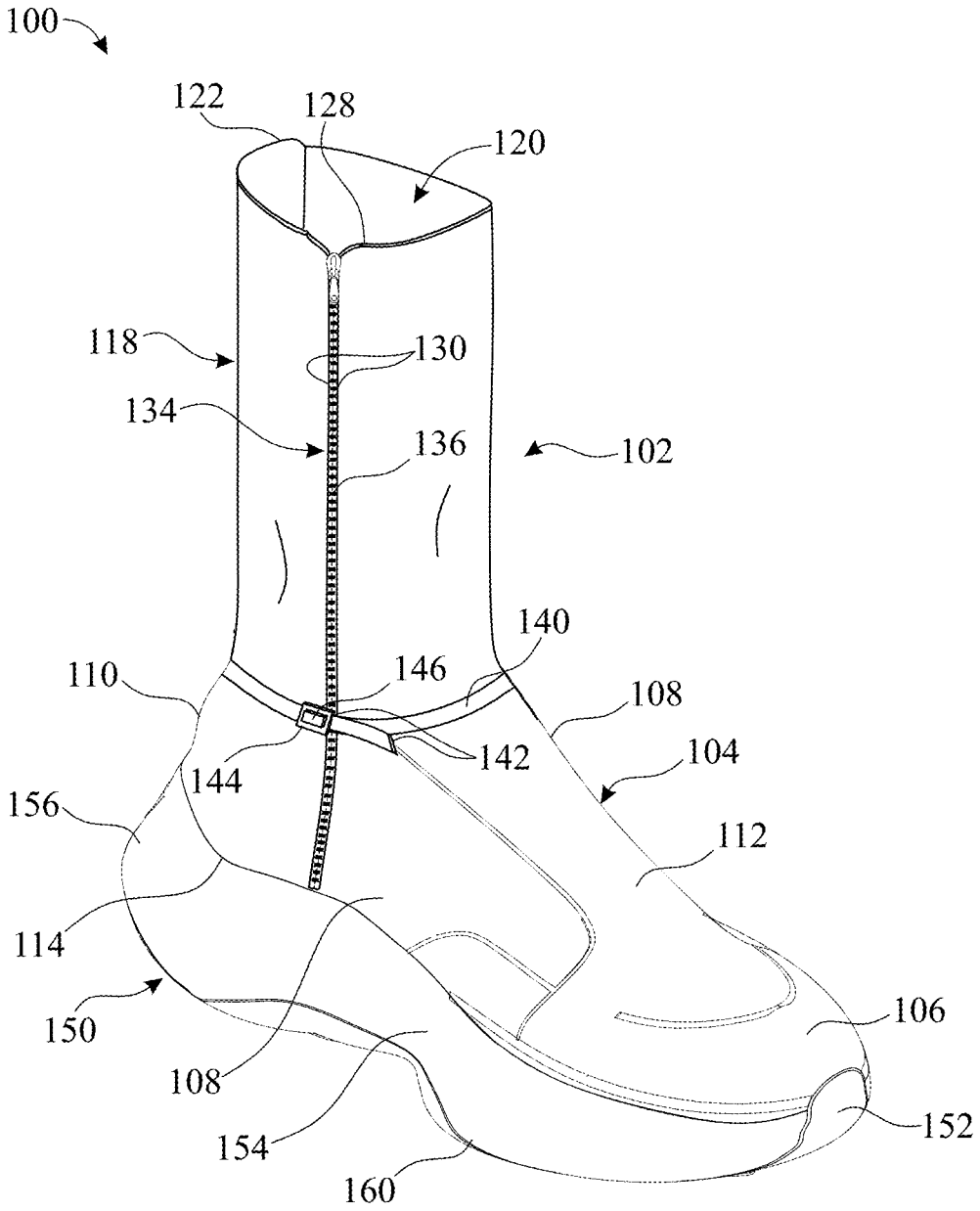
FIG. 1 presents a front perspective view illustrating a braced footwear system in accordance with an illustrative embodiment of the present invention, with the slit closure mechanism deploying the slit in the closed slit configuration.

In some embodiments, the footwear 102 may be a shoe. In other embodiments, the footwear 102 may be a boot. Accordingly, a footwear ankle portion 118 may extend upwardly from the footwear body 104. As illustrated in FIG. 1, the footwear ankle portion 118 may have an ankle portion interior 120. An upper ankle portion edge 122 may circumscribe the ankle portion interior 120 at the upper end of the footwear ankle portion 118.

As further illustrated in FIG. 1, the footwear ankle portion 118 may include a slit 128 having side slit edges 130. As illustrated in FIGS. 4A and 4B, the side slit edges 130 of the slit 128 may be separated to deploy the slit 128 from a closed slit configuration (FIG. 4A) to an open slit configuration (FIG. 4B). The open slit configuration of the slit 128 may facilitate placement of the wearer's foot into and removal of the wearer's foot from the footwear 102.

In some embodiments, a slit closure mechanism 134 may facilitate selective deployment of the slit 128 in the closed slit configuration and the open slit configuration. The slit closure mechanism 134 may include any device or mechanism or combination thereof capable of facilitating closure and opening of the slit 128. For example and without limitation, in some embodiments, the slit closure mechanism 134 may include a zipper 136. In some embodiments, the slit closure mechanism 134 may additionally or alternatively include snaps, buttons, hook and loop fasteners and/or laces, for example and without limitation.

In some embodiments, a releasable closure strap 140 may be selectively securable around the footwear ankle portion 118. The closure strap 140 may be operable to secure the slit closure mechanism 134 in the closed slit configuration of the slit 128.

As particularly illustrated in FIGS. 1 and 2B, the closure strap 140 may have strap ends 142. A strap buckle 144 may releasably secure the strap ends 142 to each other.

In some embodiments, the strap buckle 144 may have a strap buckle release button 146. The strap buckle release button 146 may be depressed to release the strap buckle 144 and facilitate separation of the strap ends 142 from each other.

In some embodiments, the footwear sole 150 may have a front sole portion 152, side sole portions 154 and a rear sole portion 156. The front sole portion 152, the side sole portions 154 and the rear sole portion 156 of the footwear sole 150 may correspond in position to the front body portion 106, the side body portions 108 and the rear body portion 110, respectively, of the footwear body 104. The brace space 162 (FIG. 3) may be coextensive in area with at least part of the front sole portion 152, the side sole portions 154 and the rear sole portion 156 of the footwear sole 150.

As illustrated in FIG. 3, the footwear sole 150 may include an outer sole panel 160. The outer sole panel 160 may form the front sole portion 152, the side sole portions 154 and the rear sole portions 156 of the footwear sole 150. The brace space 162 may be formed by and between the outer sole panel 160 of the footwear sole 150 and the bottom body surface 114 of the footwear body 104.

As further illustrated in FIG. 3, in some embodiments, a brace panel 164 may line an interior surface of the outer sole panel 160. The vertical brace members 168 of the footwear brace 166 may extend between the brace panel 164 and the bottom body surface 114 of the footwear body 104.

In some embodiments, each vertical brace member 168 of the footwear brace 166 may include a pair of adjacent brace member elements 170. The brace member elements 170 may impart a spring action to each vertical brace member 168. The vertical brace members 168 may impart vertical support to the foot (not illustrated) of the footwear wearer as the footwear wearer stands, walks, runs or jumps in the footwear.

The brace member elements 170 of each vertical brace member 168 may be bowed outwardly with respect to each other. Accordingly, the brace member elements 170 may impart the spring action to each vertical brace member 168. Each brace member element 170 of each vertical brace member 168 may be fabricated of a flexible or resilient material such as metal, plastic, rubber, composite materials, or combinations thereof. In some embodiments, each brace member element 170 of each vertical brace member 168 may be a solid flexible material. In some embodiments, each vertical brace member 168 may include at least one coiled spring.

As further illustrated in FIG. 3, in some embodiments, horizontal brace members 172 may connect the adjacent vertical brace members 168 to each other. For example and without limitation, the horizontal brace members 172 may connect the brace member elements 170 of each vertical brace member 168 to the brace member elements 170 of the adjacent vertical brace members 168.

Each horizontal brace member 172 of the footwear brace 166 may be fabricated of a flexible or resilient material such as metal, plastic, rubber, composite materials, or combinations thereof. In some embodiments, each horizontal brace member 172 may be a solid flexible material. In some embodiments, each horizontal brace member 172 may include at least one coiled spring.

As illustrated in FIGS. 4A, 4B and 5, in typical application, the braced footwear system 100 may be donned by a footwear wearer 176 to conceal deformity, injury or paralysis in the foot of the wearer 176. Accordingly, the strap buckle 144 on the closure strap 140 may initially be released by depression of the strap buckle button 146. This action may separate the strap ends 142 of the closure strap 140 to facilitate access to the slit closure mechanism 134.

The slit closure mechanism 134 may next be deployed from the closed slit configuration illustrated in FIG. 4A to the open slit configuration illustrated in FIG. 4B. The wearer 176 may then place the foot through the ankle portion interior 120 of the footwear ankle portion 118 and into the footwear body 104 of the footwear 102. The slit closure mechanism 134 may then be deployed back to the closed slit configuration illustrated in FIG. 4A and the closure strap 140 resecured by deployment of the strap buckle 144. As the wearer 176 stands, walks, runs or jumps, the footwear brace 166 may impart vertical support to the foot of the wearer 176. The footwear 102 may be removed from the foot of the wearer 176 by reversing the steps above.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A footwear system configured to conceal deformity, injury or paralysis in a foot of a wearer, the footwear system comprising:

footwear comprising:

a footwear body;

a footwear sole on the footwear body; and at least one footwear brace in the footwear sole, the footwear brace concealed in the footwear sole and configured to impart support to the foot of the wearer and further comprising at least one brace space provided in the footwear sole, and wherein the at least one footwear brace is provided in the brace space, and wherein the footwear body includes a front body portion, side body portions, a rear body portion a top body portion and a bottom body surface, and wherein the footwear sole is provided on the bottom body surface of the footwear body, and wherein the footwear sole has a front sole portion, side sole portions and a rear sole portion, which correspond in position to the front body portion, the side body portions and the rear body portion, respectively, of the footwear body, and wherein the brace space is coextensive in area with at least part of the front sole portion, the side sole portions and the rear sole portion, and wherein the footwear sole further includes an outer sole panel which forms the front sole portion, the side sole portions and the rear sole portions of the footwear sole and wherein the brace space is formed by and between the outer sole panel of the footwear sole and the bottom body surface of the footwear body, and wherein a brace panel lines an interior surface of the outer panel and wherein a plurality of vertical brace members of the footwear brace extend between the brace panel and the bottom body surface of the footwear body, and wherein each of the plurality of vertical brace members of the footwear brace includes a pair of adjacent brace member elements, and further comprising a plurality of horizontal brace members that connect the adjacent vertical brace members to each other.

2. The footwear system of claim 1, wherein the footwear is a shoe.

3. The footwear system of claim 1, wherein the footwear is a boot.

4. The footwear system of claim 3, wherein the boot includes a footwear ankle portion extending from the footwear body.

5. The footwear system of claim 4, wherein the footwear ankle portion has an ankle portion interior and an upper ankle portion edge.

6. The footwear system of claim 4, wherein the footwear ankle portion includes a slit having side slit edges, which side slit edges of the slit are capable of being separated to deploy the slit from a closed slit configuration to an open slit configuration to facilitates placement of the wearer's foot into and removal of the wearer's foot from the footwear.

7. The footwear system of claim 6, further comprising a slit closure mechanism that facilitates selective deployment of the slit in the closed slit configuration and the open slit configuration.

8. The footwear system of claim 7, wherein the slit closure mechanism includes a zipper.

9. The footwear system of claim 7, wherein the slit closure mechanism include at least one of snaps, buttons, hook and loop fasteners, and laces.

10. The footwear system of claim 6, further comprising a releasable closure strap that is selectively securable around the footwear ankle portion.

11. The footwear system of claim 10, wherein the releasable closure strap has strap ends which are releasably secured to each other by a strap buckle.

12. The footwear system of claim 11, wherein the strap buckle has a strap buckle release button.

13. The footwear system of claim 1, wherein the adjacent brace member elements of each of the plurality of vertical brace members are bowed outwardly with respect to each other.

* * * * *